US009394089B2

(12) United States Patent
Silvers et al.

(10) Patent No.: US 9,394,089 B2
(45) Date of Patent: Jul. 19, 2016

(54) DISPENSER FOR POURING LIQUIDS

(71) Applicant: Synergy Merchandising Pty Ltd, Ultimo (AU)

(72) Inventors: Michael Henry Silvers, Crows Nest (AU); Sam Tam, Crows Nest (AU)

( * ) Notice: Subject to any disclaimer, the term of this patent is extended or adjusted under 35 U.S.C. 154(b) by 0 days.

(21) Appl. No.: 14/012,936

(22) Filed: Aug. 28, 2013

(65) Prior Publication Data

US 2015/0060499 A1 Mar. 5, 2015

(51) Int. Cl.
*B67D 3/00* (2006.01)
*B65D 47/32* (2006.01)
*B65D 47/06* (2006.01)

(52) U.S. Cl.
CPC ..... *B65D 47/32* (2013.01); *B65D 47/06* (2013.01)

(58) Field of Classification Search
CPC ..... B65D 47/06; B65D 47/32; B67D 3/044; B67D 3/046; B67D 3/048
USPC ..... 222/481.5, 560–570
See application file for complete search history.

(56) References Cited

U.S. PATENT DOCUMENTS

| | | | | |
|---|---|---|---|---|
| 1,151,997 | A * | 8/1915 | Beck et al. | B65D 47/06 222/464.1 |
| 1,913,393 | A * | 6/1933 | Jones | 222/482 |
| 2,642,207 | A * | 6/1953 | Renzi | 222/479 |
| 2,825,495 | A * | 3/1958 | Fazio | 222/478 |
| 3,168,221 | A * | 2/1965 | Parker | 222/109 |
| 3,920,149 | A * | 11/1975 | Fortino et al. | 222/1 |
| 3,966,099 | A * | 6/1976 | Sanford et al. | 222/478 |
| 4,877,159 | A * | 10/1989 | Strand | 222/484 |
| 5,211,318 | A * | 5/1993 | Govatzidakis | 222/479 |
| 6,230,944 | B1 * | 5/2001 | Castellano et al. | 222/481.5 |
| 6,742,678 | B1 * | 6/2004 | Krystopik, Jr. | 222/481.5 |
| D520,359 | S * | 5/2006 | Sach | D9/439 |
| 7,527,180 | B2 * | 5/2009 | Allen et al. | 222/481.5 |
| 8,944,297 | B2 * | 2/2015 | Agassi et al. | 222/481.5 |
| 2005/0194410 | A1 * | 9/2005 | Pham | 222/569 |
| 2006/0000855 | A1 | 1/2006 | Allen et al. | |
| 2008/0017675 | A1 * | 1/2008 | Pressey | 222/481.5 |
| 2014/0034686 | A1 * | 2/2014 | Guerette et al. | 222/504 |

FOREIGN PATENT DOCUMENTS

GB 821769 A 10/1959

OTHER PUBLICATIONS

PCT International Search Report and Written Opinion of the U.S. Searching Authority, completed on Nov. 13, 2014 and mailed on Dec. 22, 2014.

* cited by examiner

*Primary Examiner* — Lien Ngo
(74) *Attorney, Agent, or Firm* — James M. Smedley LLC; James Michael Smedley, Esq.

(57) ABSTRACT

A pouring dispenser for pouring liquid from a bottle comprises a sleeve adapted to be removably attached with the neck of the bottle and extend from the neck of the bottle. The sleeve comprises a cork portion to be inserted into the neck of the bottle. A pouring nozzle with the sleeve is formed with the cork portion as an integral component, such that the pouring nozzle is in fluid communication with the interior of the bottle. There is a removable breather tube that fits in the cork portion.

18 Claims, 12 Drawing Sheets

DISPENSER FOR POURING LIQUIDS

BACKGROUND

1. Field

The present invention broadly relates to pouring dispensers and, in particular, to a bottle mounted pouring dispenser for pouring liquids such as liquor. The invention will hereinafter be described with reference to this application. However, it will be appreciated that the invention is not limited to this particular field of use.

2. General Background

Bottle mounted drink pouring dispensers have long been used in the bar and restaurant industry, as well as in the home, for dispensing liquors in a controlled fashion and with minimal spillage. In their simplest construction, such pouring dispensers comprise a cork or other flexible sealing device designed to seal the bottle opening, and a pour nozzle extending from the interior of the bottle through the cork or other scaling device. The nozzle allows fluid communication between the interior of the bottle and the exterior of the bottle. The nozzle is typically bent to facilitate pouring the liquid from the bottle into a container. An airflow vent in fluid communication with the bottle interior and in communication with the atmosphere facilitates pouring, allowing air to enter the bottle from the atmosphere upon liquid being poured from the bottle, equalizing the pressure.

Known pouring dispensers comprise a moulded plastic or metal pouring nozzle extending through an annular base portion. The annular base portion comprises a cylindrical extension which fits securely into the neck of the bottle, sealing the bottle. This cylindrical extension is commonly over-fitted with a flexible cork, rubber or other sealing device. This sealing device retains the pouring nozzle and base over the mouth of the bottle during use. The pouring nozzle extends through the annular base portion and cylindrical extension such that the interior of the bottle is in fluid communication with the exterior of the bottle by means of the pouring nozzle. The pouring dispenser is therefore inserted into the neck of a bottle to facilitate pouring from the bottle.

Pouring dispenser cleaning is of particular importance in bars and restaurants. Known pouring dispensers require removal of the entire dispenser for cleaning, leaving the bottle open to the atmosphere or requiring that bottles be covered with plastic wrap or an alternate water impermeable material. This process is time-consuming and not secure. Moreover the need for easy removal of the pouring dispenser from the bottle for the purpose of cleaning means that the pouring dispenser can be knocked off at inopportune times, such as while pouring liquid from the bottle or when the bottle is knocked or dropped.

SUMMARY

According to a first aspect there is provided a pouring dispenser for pouring liquid from a bottle, the pouring dispenser comprising a sleeve adapted to be removably attached with the neck of the bottle, and a pouring nozzle adapted to be co-formed with and extend from the sleeve as an integrated unit, such that the pouring nozzle is in fluid communication with the interior of the bottle.

In one form a co-moulded cork is used which fits essentially directly into the spout component and can thereby eliminate a collar component.

Further there is a separable removable speed or breather tube.

In one form the sleeve is adapted to be inserted into and extend from the neck of the bottle and to form a liquid-tight seal with the neck of the bottle.

In one form the pouring nozzle is adapted to be inserted into the sleeve and to form a liquid-tight seal with the sleeve.

In one form the pouring nozzle extends through the sleeve.

In one form the sleeve comprises a neck portion, adapted to be inserted into the neck of the bottle, and an annular shoulder portion, adapted to extend from the neck of the bottle.

In one form the pouring nozzle comprises a spout portion, adapted to pour liquids, and an annular base portion. In this form the annular base portion is adapted to be removably connected with the annular shoulder portion.

In one form the pouring nozzle includes an airflow channel, the airflow channel extending from an airflow aperture in the surface of the pouring nozzle into the interior of the bottle. The airflow aperture is elliptical.

In one form the pouring dispenser further comprises a cover which is adapted for use as a measure. The cover is adapted to be removably attached with the sleeve.

In one form the sleeve extends from the neck of the bottle substantially in line with the neck of the bottle.

In one form the cover extends from the sleeve substantially in line with the sleeve.

According to a second aspect there is provided a pouring dispenser for pouring liquid from a bottle, the pouring dispenser comprising a pouring nozzle through which liquid is dispensed, the pouring nozzle being removable from the pouring dispenser.

In one form the pouring nozzle is adapted to form a liquid-tight seal with the neck of the bottle.

In one form the pouring nozzle extends from the interior of the bottle, through the pouring dispenser and is adapted to form a liquid-tight seal with the pouring dispenser.

In one form the pouring dispenser further comprises a neck portion, adapted to be inserted into the neck of the bottle, and an annular shoulder portion, adapted to extend from the neck of the bottle.

In one form the pouring nozzle comprises a spout portion, adapted to pour liquids, and an annular base portion. In this form the annular base portion is adapted to be removably connected with the annular shoulder portion.

In one form the pouring nozzle includes an airflow channel, the airflow channel extending from an airflow aperture in the surface of the pouring nozzle into the interior of the bottle. The airflow aperture is elliptical.

In one form the pouring dispenser further comprises a cover. The cover is adapted for use as a measure and is removably attached with the pouring dispenser.

In one form the pouring dispenser extends from the neck of the bottle substantially in line with the neck of the bottle.

BRIEF DESCRIPTION OF THE DRAWINGS

A preferred embodiment of the invention will now be described, by way of example only, with reference to the accompanying drawings in which.

DETAILED DESCRIPTION

Figure 1:
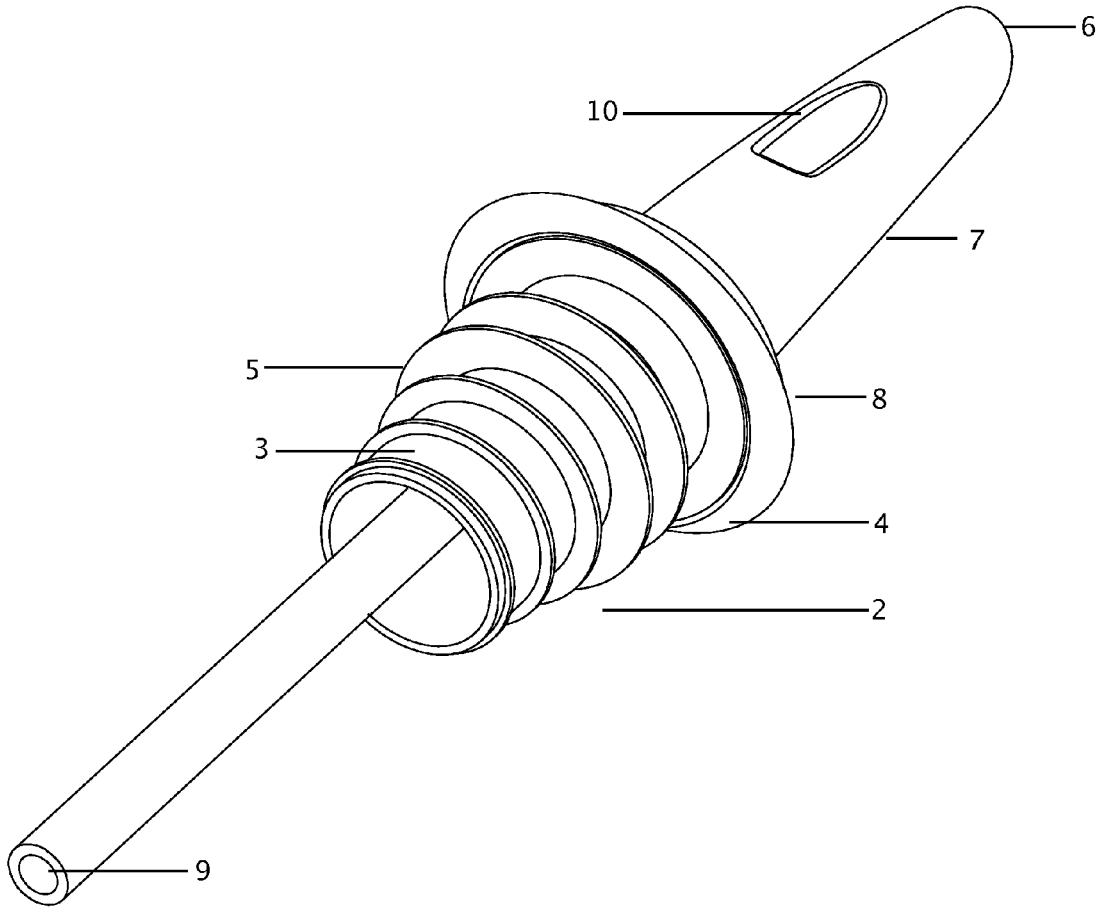
FIG. 1 is a bottom perspective view of a pouring dispenser in accordance with the preferred embodiment.

A pouring dispenser for pouring liquid from a bottle comprises a sleeve adapted to be removably attached with the neck of the bottle and extend from the neck of the bottle. The sleeve comprising a cork portion, adapted to be inserted into the neck of the bottle, and adapted to extend from the neck of the bottle.

The sleeve is formed as a body with externally directed circumferential ribs, the ribs being spaced apart, a pouring nozzle adapted to be formed with the cork portion as an integral unit. The pouring nozzle is in fluid communication with the interior of the bottle, wherein the pouring nozzle includes a removable separable airflow channel.

A co-moulded cork is applied to the pourer device. A purpose of the co-moulding is so that the cork does not detach from the pour spouts when removing out of the bottles when cleaning. With prior pourers, when fitting into smaller bottle necks and once it comes apart, the pour spouts tend to create leakage because the cork can never assemble back to the spout in the form as when the pourer is new.

In the disclosed pourer, the co-moulded cork fits essentially directly into the spout component and can thereby eliminate the collar component. This renders the product a lot simpler to use and more cost effective in production. Also without the collar component, it allows more space for the cork to flex when fitting into smaller bottle necks. Hence the advantage of fitting into a larger variety of bottle necks.

With metal speed pourers, due to cheap cost/construction, speed pourers are badly designed. When removing a speed pourer from a tight fitting bottle, the cork which is force fitted onto the pourer, tends to detach from its body, with the cork remaining in the bottle. The body of the pourer is left in a bartender's hand. This causes a frustrated and wasted effort, and is time and arising inconvenience to remove the cork from inside the bottle neck. Thereafter trying to re-attach onto the spout is highly problematic. The cork never fits back as well onto the pourer again, thereby increasing bottle leakage, which results from the gap forming between the cork and its join back onto the spout. The entire pourer shortly thereafter needs replacement.

A separable speed or breather tube can be inserted and replaced if and when required. A purpose of the separable breather tube is to create a shorter pouring speed. A reason for having a separate component is so that there is the facility to could create different, namely shorter or longer, breather tube. This was not previously possible due to manufacturing capabilities. Also as a separate component, a user can replace it after a period of usage whereby this can extend the product life.

The breather tube is created out of polypropylene (a flexible material). This is to prevent damages or alteration of the air intake which can affect the speed of pouring. As such it is possible with the disclosed pourer to have a more consistent pour spout.

The speed tube being replaceable is quite an innovation, metal speed tubes tend to either rust or break/bend. When broken or bent the pourer starts to pour liquid inconsistently (liquid volume either slows up or down) or cannot pour at all, resulting in the entire spout having to be replaced.

Also there is an opportunity to provide different lengths of speed tubes to allow for a bartender to either slow down or speed up the rate of "volume" flow of their pour. Bartenders rely on a consistent volume flow when pouring liquids particularly when "free-pouring" which is the art of pouring a measured amount of alcohol based on timing, without using a jigger or measuring device. A standard speed pourers takes 1 second of pouring time to dispense 10 mL or ⅓ oz of alcohol or liquid free pouring is a popular way of serving alcohol, with bartenders priding themselves on the ability to time how they measure a correct amount of alcohol.

The airflow channel extends from an elliptical airflow aperture in the surface of the pouring nozzle into the interior of the bottle; the sleeve having a first axial bore, the pouring nozzle having a second axial bore, the first axial bore and the second axial bore being substantially straight and coaxial from an end of both of the respective two bores for location inside the neck to position outside the neck; and the second bore including an inside wall and at least one side of the inside wall of the second bore being straight from end to end of the second bore; the There is a cover for use as a measure, the cover being removably attached with the sleeve, and wherein the sleeve extends from the neck of the bottle substantially in line with the neck of the bottle; and wherein the cover extends from the sleeve substantially in line with the sleeve.

The sleeve is adapted to form a liquid-tight seal with the neck of the bottle. The pouring nozzle is adapted to be inserted into the sleeve. The pouring nozzle is adapted to form a liquid-tight seal with the sleeve. The pouring nozzle comprises a spout portion, adapted to pour liquids, and an annual base portion.

A pouring dispenser for pouring liquid from a bottle, the pouring dispenser comprising: a sleeve adapted to be removably attached with the neck of the bottle and extend from the neck of the bottle. The sleeve comprise a cork portion, adapted to be inserted into the neck of the bottle, the sleeve portion having a first axial bore, the sleeve being formed as a body with externally directed circumferential ribs, the ribs being spaced apart, a pouring nozzle having a second axial bore. The pouring nozzle passes through the sleeve and being formed with the cork portion as an integral component, such that the pouring nozzle is in fluid communication with the interior of the bottle.

The first axial bore and the second axial bore are substantially straight and coaxial from an end of both of the respective two bores for location inside the neck to position outside the neck. The second bore includes an inside wall and at least one side of the inside wall of the second bore being straight from end to end of the second bore; wherein the pouring nozzle includes an airflow channel, the airflow channel extending from an airflow aperture in the surface of the pouring nozzle into the interior of the bottle;

There is a cover for use as a measure wherein the airflow aperture is elliptical.

The pouring nozzle includes a wall portion extending from a free end of the nozzle towards a position adjacent the annular sleeve, the wall tapering from a relatively narrower portion to a relatively broader portion adjacent the shoulder. The aperture in the airflow channel ends substantially flush with the elliptical aperture and at a position relatively recessed from the outer face of the wall. The pouring nozzle includes a peripheral wall, and the tip of the pouring nozzle ends in a transversely cut end of the wall, the transversely cut end being longer on the side of the peripheral wall surface of the pouring nozzle having the aperture and shorter on the opposite side of the peripheral wall.

The second bore is narrower at the free end remote from the shoulder and gradually increases in diameter towards a position substantially adjacent to the sleeve and thereafter is of a substantially constant diameter.

The aperture in the airflow channel ends substantially flush with the elliptical aperture and at a position relatively recessed from the outer face of the wall, and wherein the spout includes an outer wall surface, the outer wall surface being a substantially regular surface tapering from the shoulder towards the tip, and the tapering surface line of the surface upstream of the elliptical aperture and downstream of the elliptical aperture, and the elliptical aperture being an only interruption in a continuity of the surface upstream of the elliptical aperture and downstream of the elliptical aperture.

The aperture in the airflow channel ends substantially flush with the elliptical aperture and at a position relatively recessed from the outer face of the wall, and wherein the nozzle includes an outer wall surface, the outer wall surface being a substantially regular surface tapering from the shoulder towards the tip, and the tapering surface line of the surface upstream of the elliptical aperture and downstream of the elliptical aperture, and the elliptical aperture being an only interruption in a continuity of the surface upstream of the elliptical aperture and downstream of the elliptical aperture.

The pouring dispenser comprising: a sleeve adapted to be removably attached with the neck of the bottle and extend from the neck of the bottle, the sleeve comprising a cork portion, adapted to be inserted into the neck of the bottle, and adapted to extend from the neck of the bottle.

The sleeve is formed as a body with externally directed circumferential ribs, the ribs being spaced apart, a pouring nozzle, such that the pouring nozzle is in fluid communication with the interior of the bottle, wherein the pouring nozzle includes a removable airflow channel.

The cork portion and nozzle are integrally formed as a single unit.

A pouring nozzle is attached with and is in fluid communication with the interior of the bottle. The pouring nozzle includes a removable airflow channel, the airflow channel extending from an airflow aperture in the surface of the pouring nozzle into the interior of the bottle.

The aperture in the airflow channel ends substantially flush with the aperture.

There is a cover for use as a measure, the cover is removably clipped with the sleeve, and wherein the sleeve extends from the neck of the bottle substantially in line with the neck of the bottle.

Figure 2:
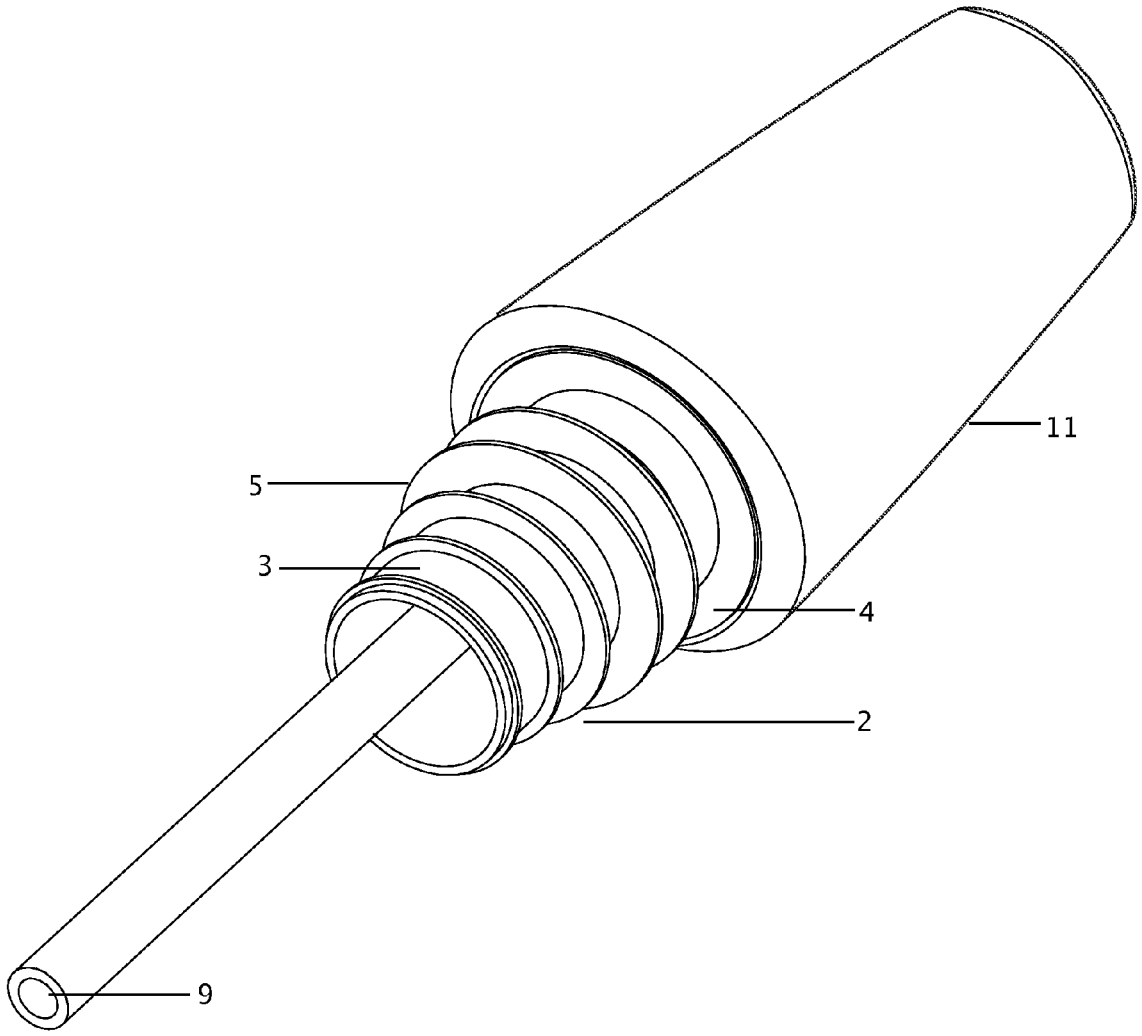
FIG. 2 is a bottom perspective view of the pouring dispenser of FIG. 1, with cover.
Figure 3:
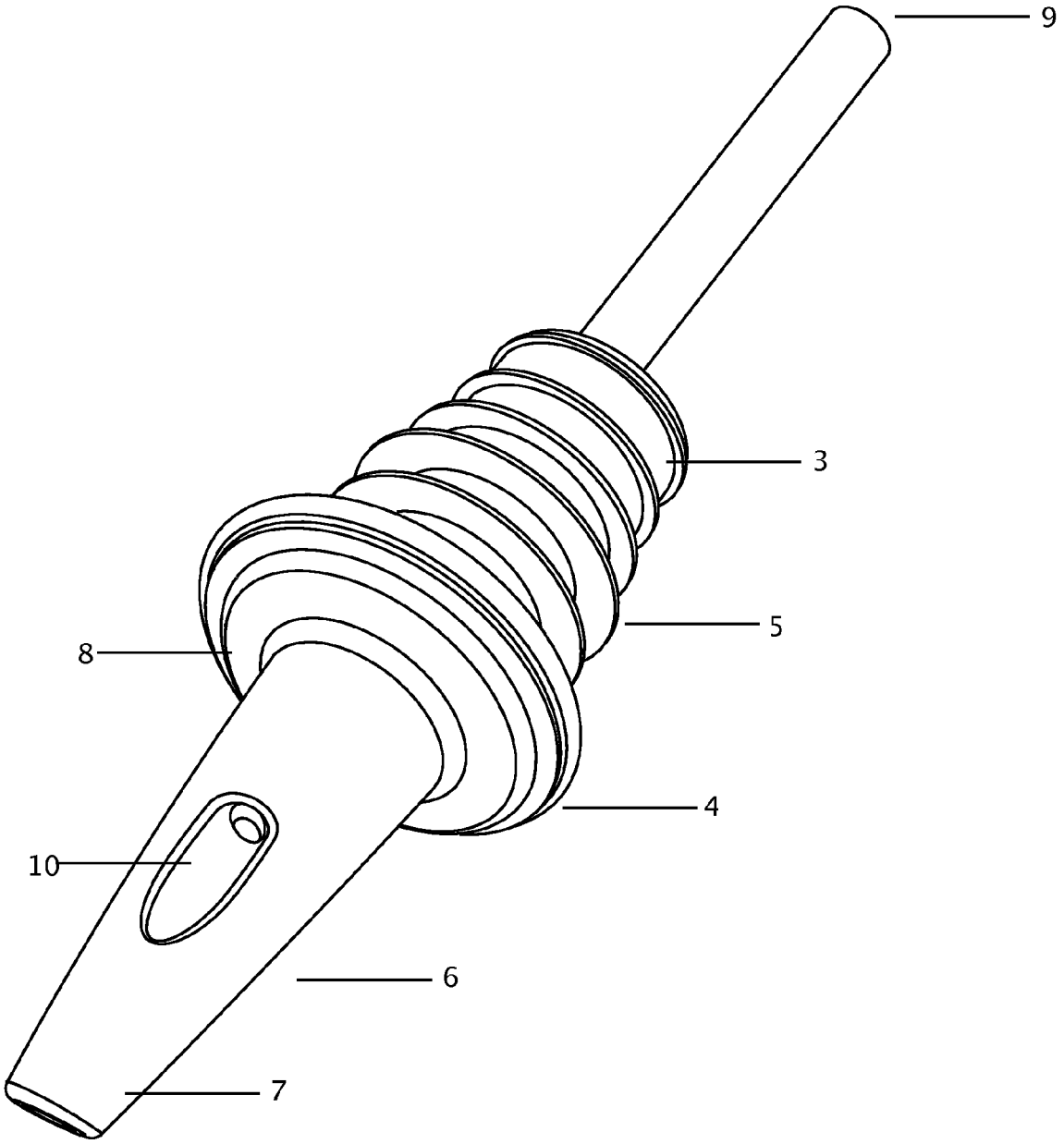
FIG. 3 is a top perspective view of the pouring dispenser of FIG. 1.
Figure 4:
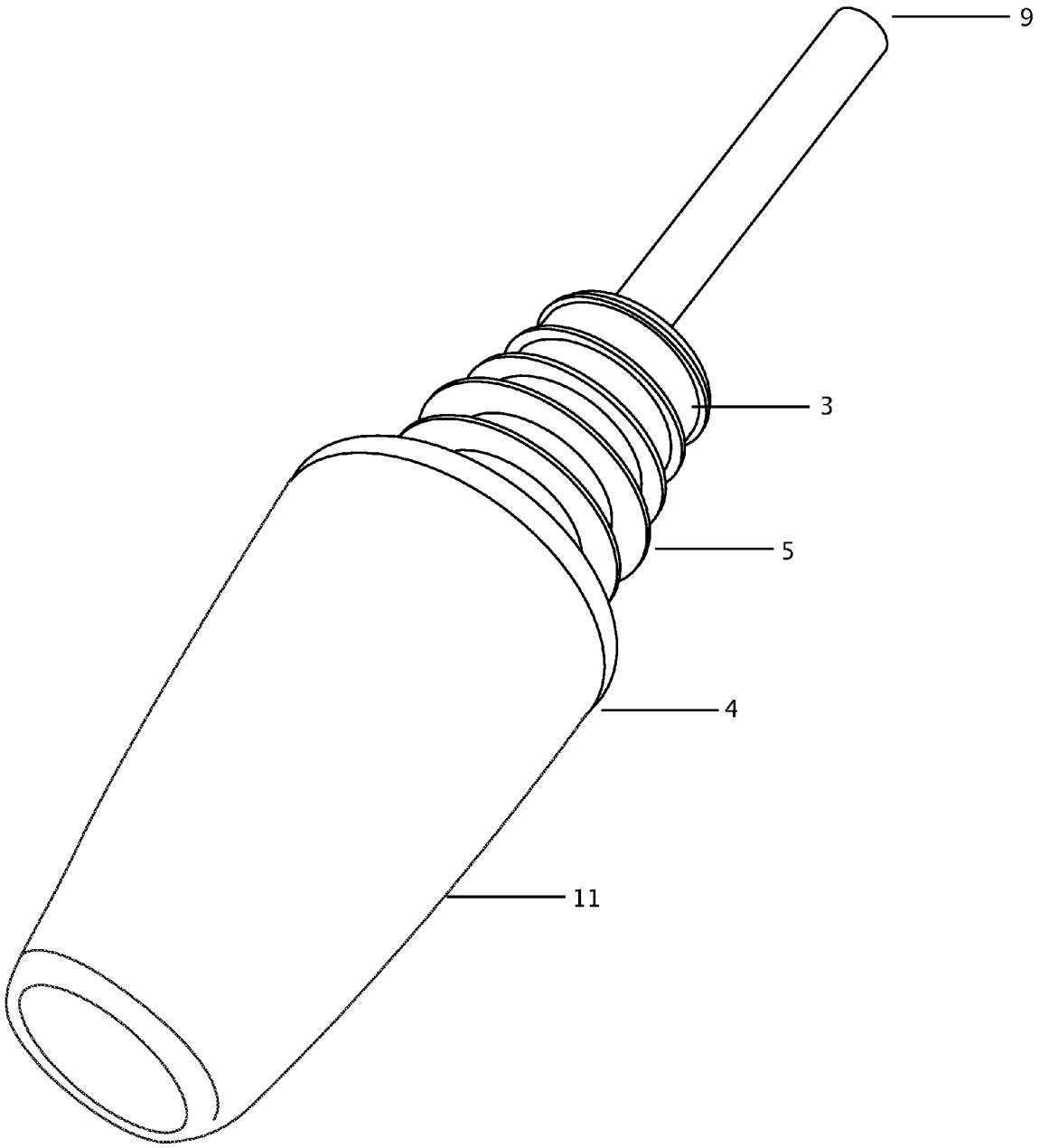
FIG. 4 is top perspective view of the pouring dispenser of FIG. 1, with cover.
Figure 5:
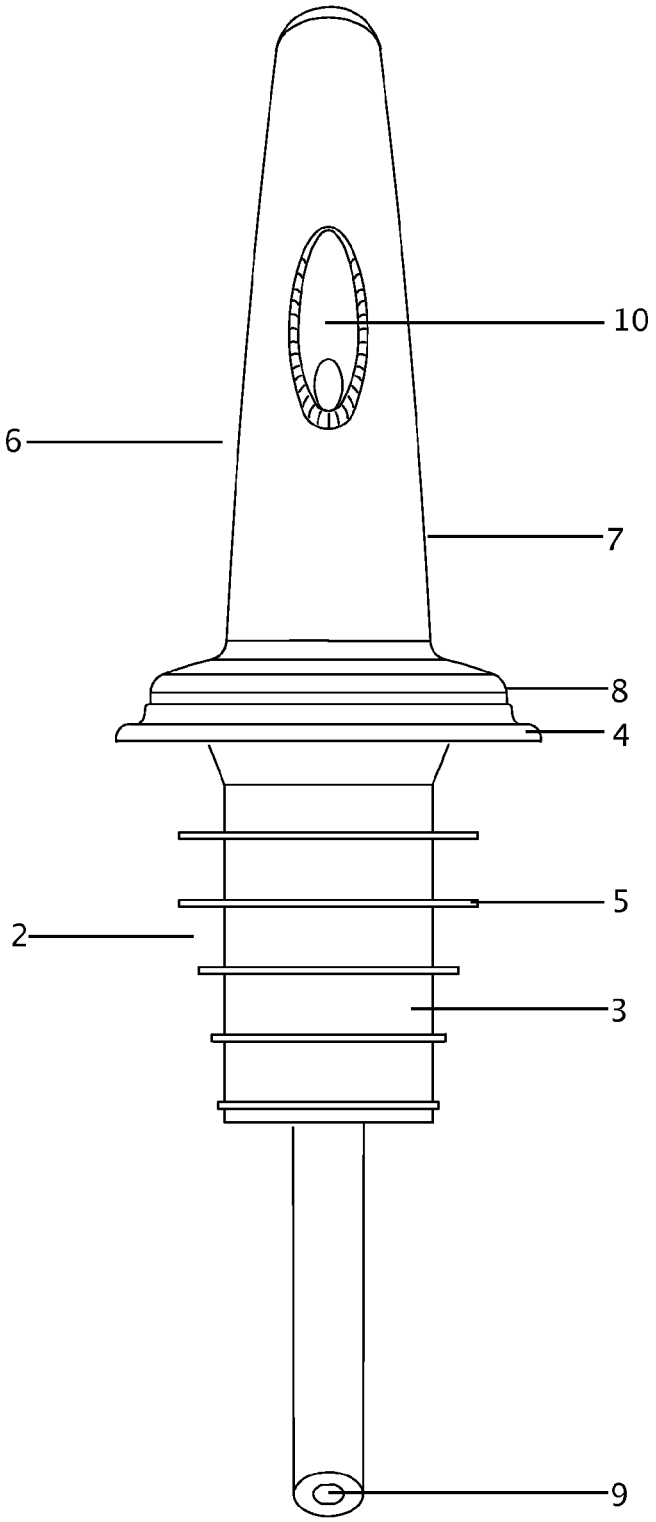
FIG. 5 is a front view of the pouring dispenser of FIG. 1.
Figure 6:
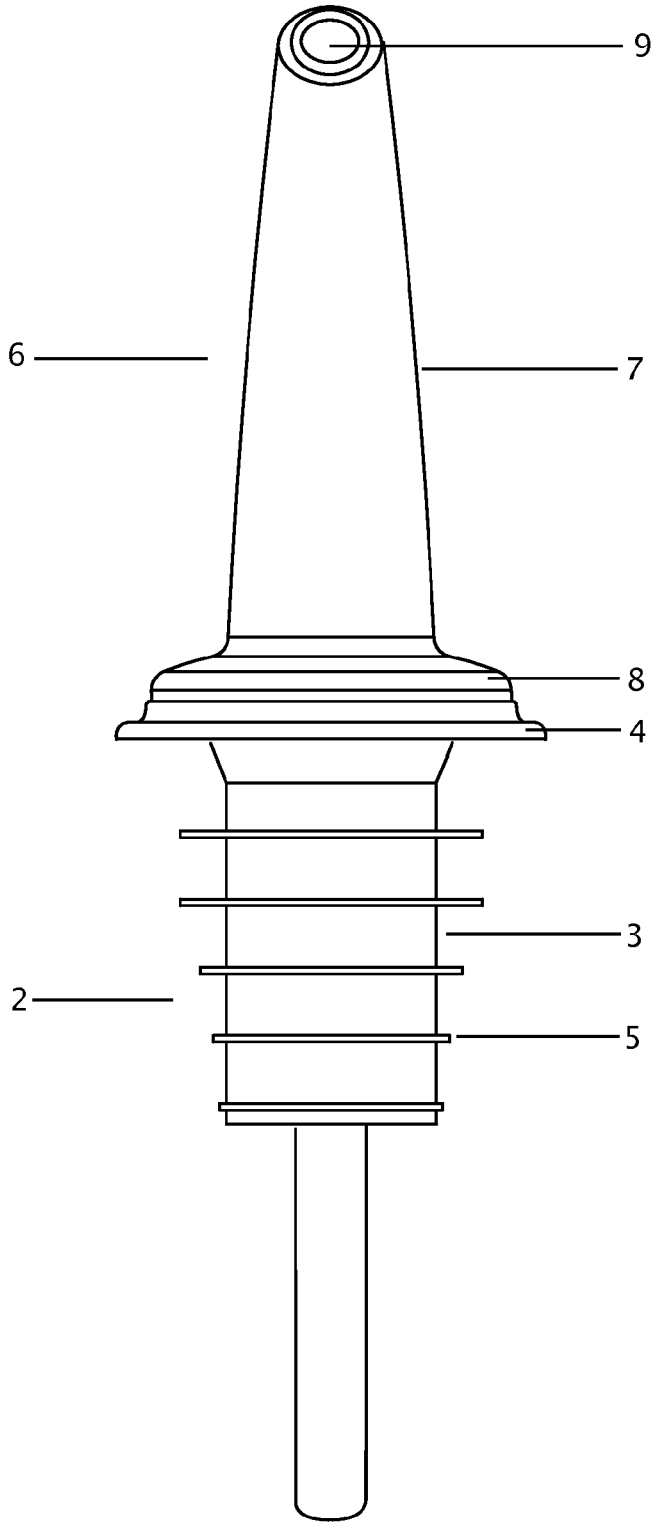
FIG. 6 is a rear view of the pouring dispenser of FIG. 1.
Figure 7:
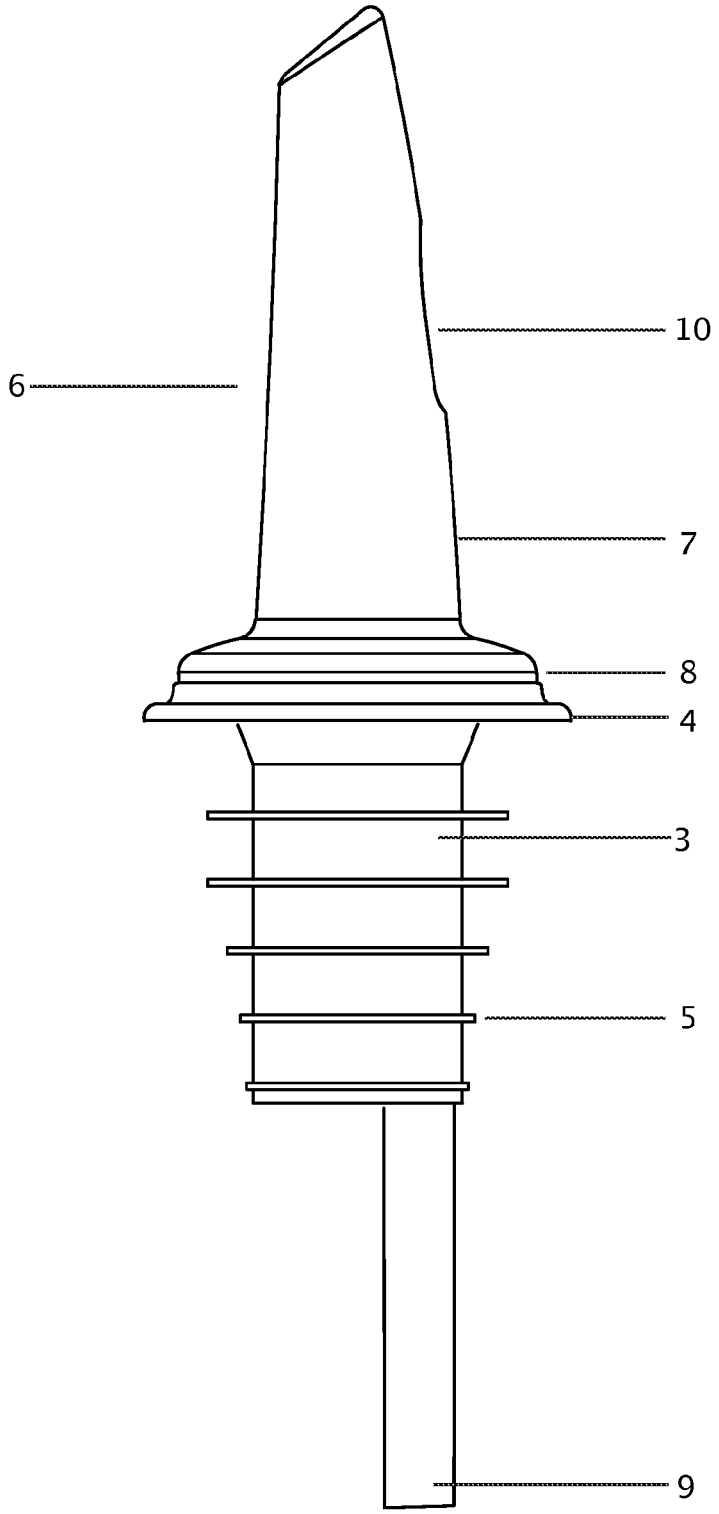
FIG. 7 is a side view of the pouring dispenser of FIG. 1.
Figure 8:
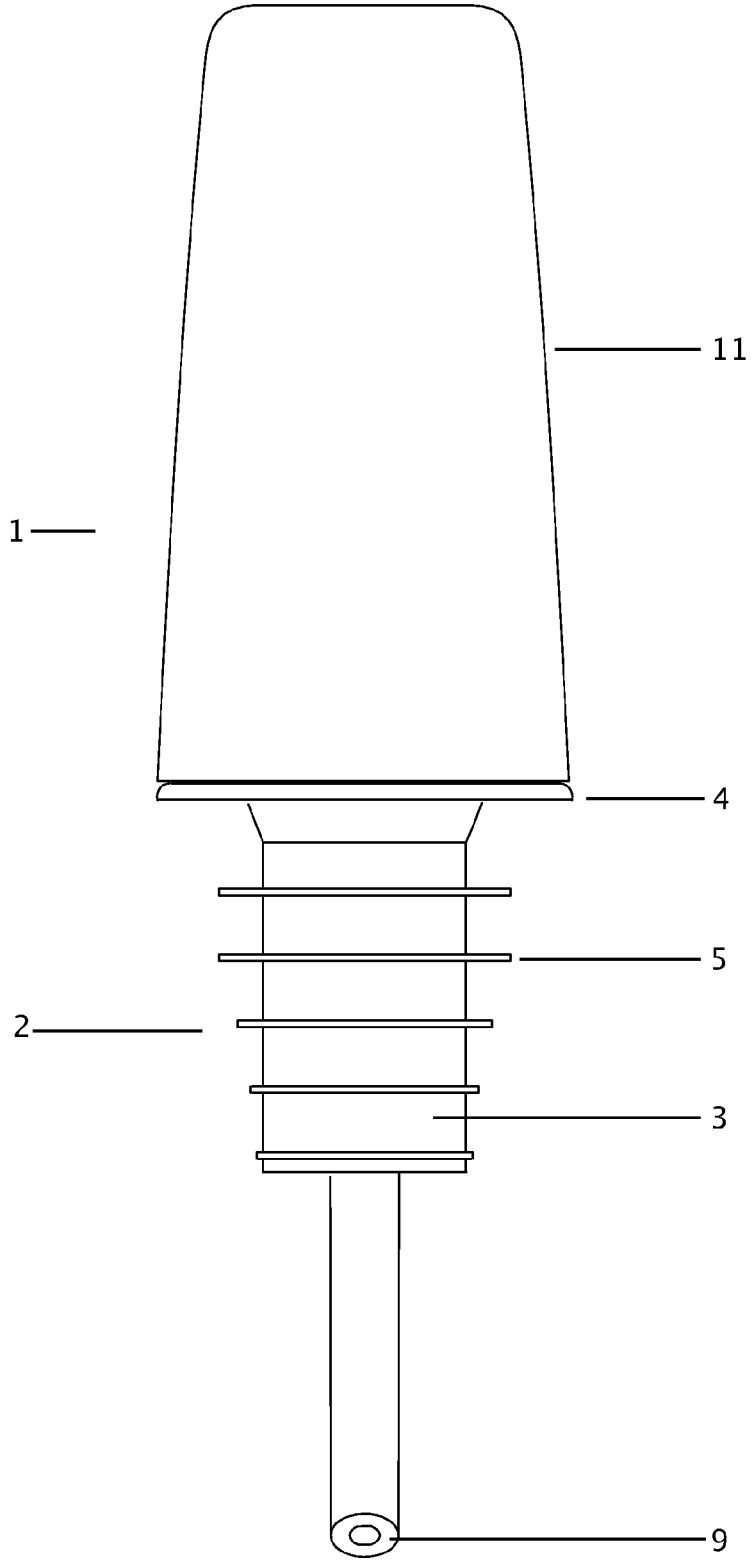
FIG. 8 is a side view of the pouring dispenser of FIG. 1, with cover.
Figure 9:
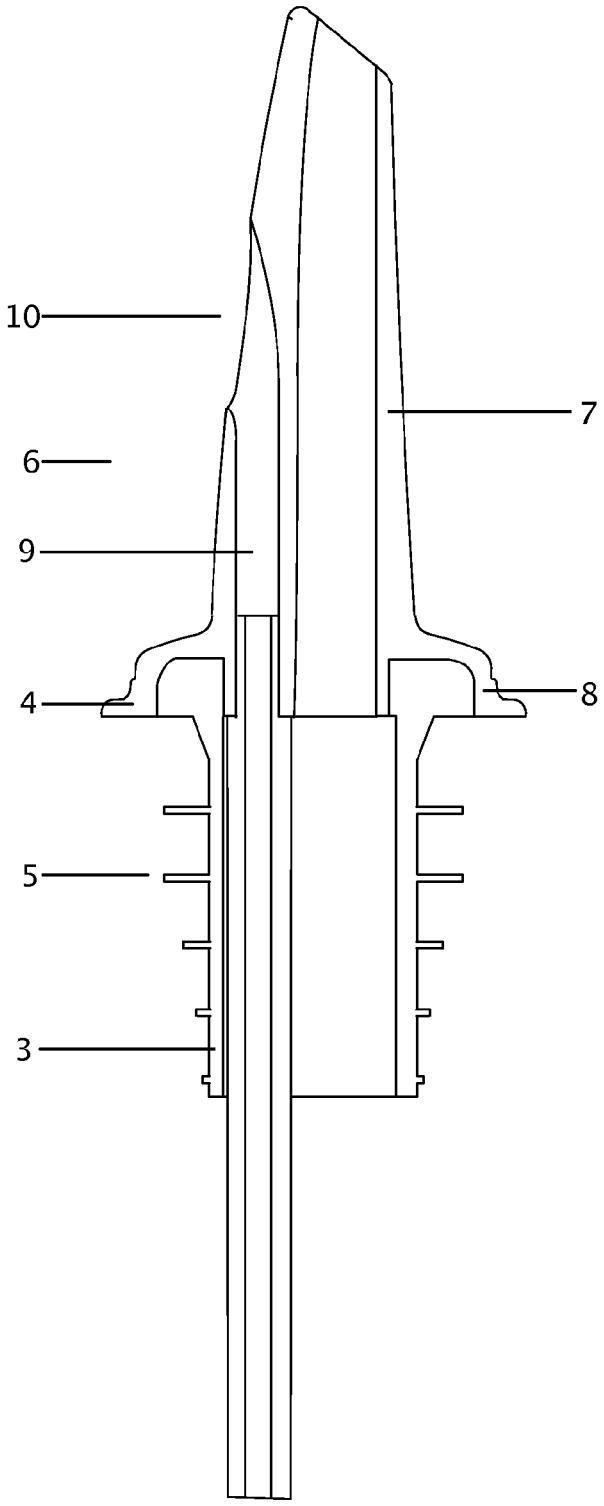
FIG. 9 is a cross-sectional view of the pouring dispenser of FIG. 1.
Figure 10:
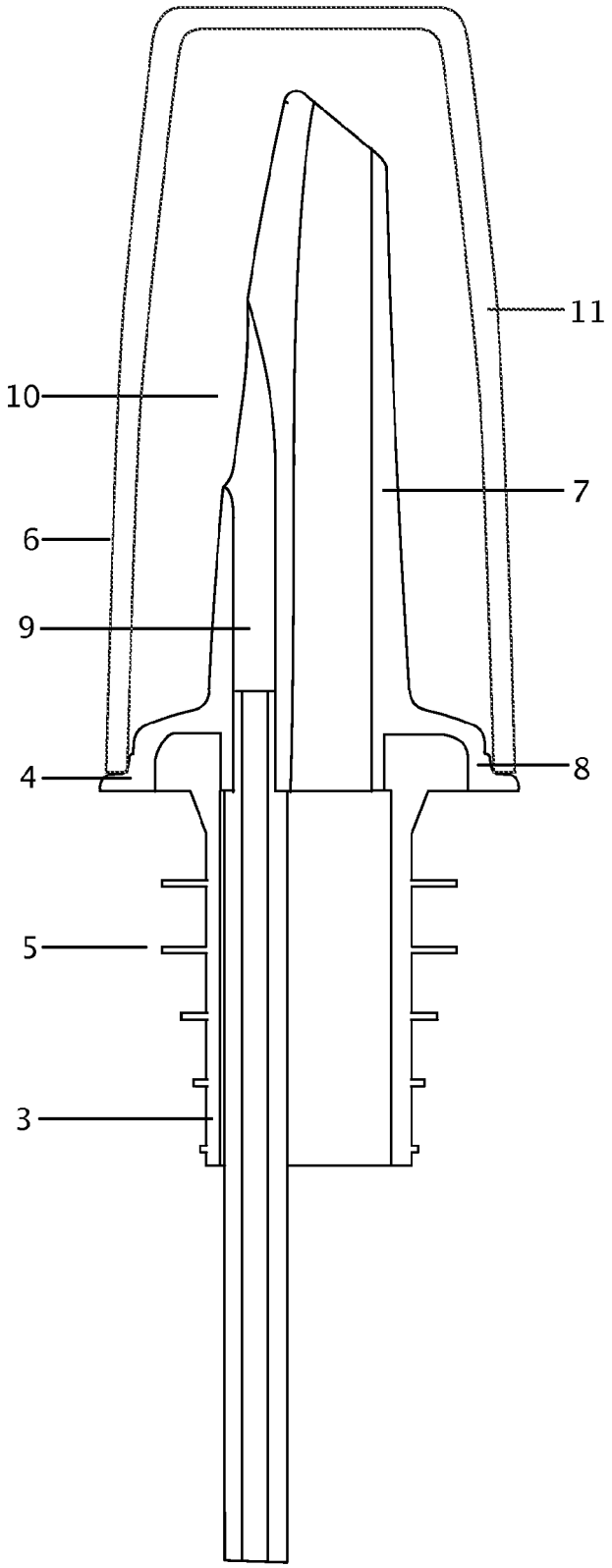
FIG. 10 is a cross-sectional view of the pouring dispenser of FIG. 1, with cover.
Figure 11:
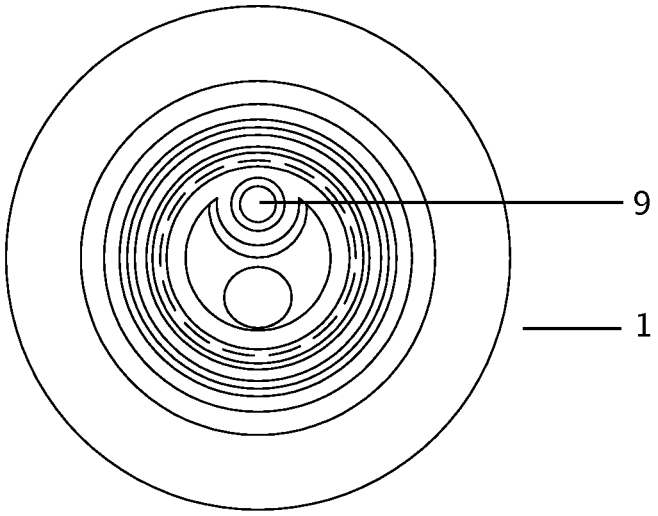
FIG. 11 is a bottom view of the pouring dispenser of FIG. 1.
Figure 12:
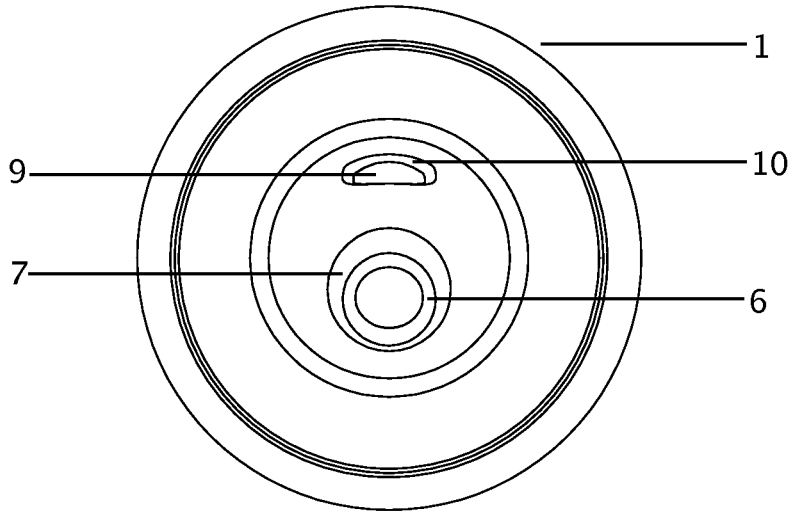
FIG. 12 is a top view of the pouring dispenser of FIG. 1.

FIGS. 1 through 12 depict a pouring dispenser 1 for pouring liquid from a bottle (not illustrated). The pouring dispenser 1 comprises a sleeve 2, the sleeve 2 comprising a cylindrical neck cork portion 3 and an annular shoulder portion 4. The sleeve 2 is composed of moulded plastic, metal or other material, capable of being formed or moulded. The sleeve, 2 also comprises a sealing portion 5 which over-fits the cylindrical neck cork portion 3. The sealing portion 5 is composed of a ribbed or flexible material such as rubber or cork.

In use the cylindrical neck cork portion 3 of the sleeve 2 is adapted to fit inside the neck of the bottle. The sealing portion 5 ensures that the cylindrical neck portion is closely fitted inside the neck of the bottle such that little or no fluid escapes the bottle by flowing around the edges of the cylindrical neck cork portion 3. The annular shoulder portion 4 is adapted to extend from the bottle and be positioned abutting or proximal to the rim of the bottle neck (not illustrated) such that the pouring dispenser 1 cannot be inserted too far into the bottle. Further, the annular shoulder portion 4 can be utilized as a grip for removing the pouring dispenser 1 from the bottle.

There is no collar portion depending downwardly over the cork portion 3 from the shoulder portion 4. The cork portion 3 has been co-moulded onto and with a spout portion 7 so that this is an integral single unit.

The pouring dispenser 1 also comprises a pouring nozzle 6. The pouring nozzle 6 comprises the spout portion 7 extending through an annular base portion 8. The annular base portion 8 is adapted to be removably attached with the annular shoulder portion 4 of the sleeve 2. In one form the attachment means (not illustrated) is a resistance fit. In another form the attachment means comprises a helical thread extending outwardly from the annular shoulder portion and inwardly from the annular base portion, the thread being adapted to allow the annular base portion 8 to be threadingly attached to the annular shoulder portion 4. In another form the attachment means is a snap fit fastening such as a slight undercut around the full inner circumference of the annular base portion 8 and a slight tapering around the full circumference of the annular shoulder portion 4.

The spout portion 7 of the pouring nozzle 6 is tubular and facilitates the user dispensing a requested volume of liquid from the bottle out into a measure. The volume of liquid is preferably about 30 milliliters. The spout portion 7 is slightly curved to allow for greater pouring ease.

The pouring nozzle 6, separable speed or breather tube also comprises an airflow channel or tube 9, which is separable and removable from the cork portion 3. Different lengths of tube 9 can be fitted into the cork portion 3 as desired by the user.

The channel or breather or speed tube 9 extends from an airflow aperture 10 in the surface of the pouring nozzle 6 to the interior of the bottle. The airflow aperture 10 is elliptical in shape and is positioned close to the annular base 8 of the pouring nozzle 6, such that a user may cover the airflow cavity 10 with a thumb or forefinger in order to better control the flow of liquid through the pouring nozzle 6. The airflow channel 9 is adapted to allow air to flow into the interior of the bottle upon liquid being poured from the bottle such that the pressure in the interior and exterior of the bottle are equalized to allow for greater pouring ease.

The pouring nozzle is composed of moulded plastic, metal or other material capable of being formed or moulded.

In use the pouring nozzle 6 is inserted into the sleeve 2. The annular base portion 8 of the pouring nozzle 6 is removably attached with the annular shoulder portion 4 of the sleeve 2. The pouring nozzle 6 is therefore removable from the sleeve 2. This feature allows for a greater ease of cleaning the pouring nozzle 6 and allows for cleaning the pouring nozzle 6 while leaving sleeve 2 in place.

The pouring dispenser 1 comprises a cover 11. This is clearly illustrated in FIG. 2. The cover 11 is removably attached with the sleeve 2 by means of resistance fit, a threaded helix or a snap fit fastening such as a slight undercut around the full circumference of the sleeve 2 and a slight tapering around the full circumference of the cover 11.

In use, the cover 11 is removed from the pouring dispenser 1 and inverted such that the cover 11 can be utilized as a container for the liquid dispensed from the bottle. The cover 11 is a measure to accurately dispense a particular volume of liquid from the pouring dispenser 1. The cover 11 is adapted to accurately contain 30 mL of liquid or whatever might be a standard measure at the point of sale.

In one form the cover 11 includes gradations to indicate the volume of liquid contained within the inverted cover 11. In another form the cover 11 includes an indicator line or variation in external texture, for example, at a half measure or 15 milliliter measures.

In use the pouring nozzle 6 is removably attached with sleeve 2. When the pouring nozzle 6 is removed from the sleeve 2, cover 11 can still be placed over the sleeve 2 and removably attached with the annular shoulder portion 4 in order to seal the bottle. Thus the pouring nozzle 6 can be removed for cleaning and cover 11 can be used to seal the bottle without needing to resort to plastic wrap or other insecure means of sealing the bottle.

The attachment means (not illustrated) attaching the pouring nozzle 6 with the sleeve 2 is sufficiently stable to ensure that the pouring nozzle 6 is not accidentally separated from the sleeve 2 when the cover it is removed.

The sleeve 2 and the base of the pouring nozzle 6 extend from the bottle (not illustrated) substantially in line with the neck of the bottle. That is the annular shoulder portion 4 has a diameter slightly greater than the diameter of the opening (not illustrated) in the neck of the bottle. This reduces the risk of accidentally removing the pouring dispenser 1 when handling the bottle. The cover 11 extends from the sleeve 2 substantially in line with the annular shoulder portion 4.

The foregoing describes only a preferred embodiment of the present invention and modifications, obvious to those skilled in the art can be made thereto without departing from the scope of the present invention.

The term "comprising", and its grammatical variations, as used herein is used in the inclusive sense of "having" or "including" and not in the exclusive sense of "consisting only of".

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

We claim:

1. A pouring dispenser for pouring liquid from a bottle, the pouring dispenser comprising:

a sleeve for removable attachment to the neck of the bottle and for extending from the neck of the bottle, the sleeve comprising a cork portion for insertion into the neck of the bottle, the sleeve being formed as a body with external circumferential ribs and a pouring nozzle formed integral with the cork portion, such that the pouring nozzle is in fluid communication with an interior of the bottle via a channel integrally formed in said nozzle, wherein said pouring nozzle comprises an elliptical airflow aperture defined in said pouring nozzle; and an interchangeable breather tube made of flexible polypropylene extending from the elliptical airflow aperture through said ribbed sleeve and cork portion to the interior of the bottle, such that one open end of said tube is in the interior of the bottle and the opposite open end of said breather tube is proximate to said elliptical airflow aperture when said pouring dispenser is attached to the bottle, wherein breather tubes of different lengths may be interchangeably connected to a connection point at the base of said nozzle channel.

2. The pouring dispenser as claimed in claim 1 wherein an airflow channel extends from said elliptical airflow aperture into the interior of the bottle; the sleeve having a first axial bore, the pouring nozzle having a second axial bore, the first axial bore and the second axial bore being substantially straight and coaxial from an end of both of the respective two bores for location inside the neck to position outside the neck; and the second bore including an inside wall and at least one side of the inside wall of the second bore being straight from end to end of the second bore.

3. The pouring dispenser as claimed in claim 1 including a cover for use as a measure, the cover being removably attached with the sleeve, and wherein the sleeve extends from the neck of the bottle substantially in line with the neck of the bottle; and wherein the cover extends from the sleeve substantially in line with the sleeve.

4. The pouring dispenser as claimed in claim 1 wherein the pouring nozzle extends though the sleeve.

5. The pouring dispenser as claimed in claim 1 wherein a first axial bore and a second axial bore are substantially straight and coaxial from an end of both of the respective two bores for location inside the neck to position outside the neck; and the second bore including an inside wall and at least one side of the inside wall of the second bore being straight from end to end of the second bore; wherein said airflow channel extends from an airflow aperture in the surface of the pouring nozzle into the interior of the bottle; and wherein the airflow aperture is elliptical.

6. The pouring dispenser as claimed in claim 1 wherein the pouring nozzle includes a wall portion extending from a free end of the nozzle towards a position adjacent the annular sleeve, the wall tapering from a relatively narrower portion to a relatively broader portion adjacent the shoulder.

7. The pouring dispenser as claimed in claim 5 wherein the aperture in the airflow channel ends substantially flush with the elliptical aperture and at a position relatively recessed from the outer face of the wall.

8. The pouring dispenser as claimed in claim 1 wherein the pouring nozzle includes a peripheral wall, and the tip of the pouring nozzle ends in a transversely cut end of the wall, the transversely cut end being longer on the side of the peripheral wall surface of the pouring nozzle having an airflow aperture and shorter on the opposite side of the peripheral wall.

9. The pouring dispenser as claimed in claim 2 wherein the second bore is narrower at the free end remote from the shoulder and gradually increases in diameter towards a position substantially adjacent to the sleeve and thereafter is of a substantially constant diameter.

10. A pouring dispenser for pouring liquid from a bottle, the pouring dispenser comprising:

a sleeve configured to be attached to the neck of the bottle and extending from the neck of the bottle, the sleeve comprising a cork portion for insertion into the neck of the bottle and for extending from the neck of the bottle, the sleeve being formed as a body with external circumferential ribs, the ribs being spaced apart;

and a pouring nozzle that is in fluid communication with an interior of the bottle via a channel integrally formed in said nozzle, wherein said pouring nozzle comprises an elliptical airflow aperture defined in said pouring nozzle; and an interchangeable breather tube made of flexible polypropylene extending from the elliptical airflow aperture through said ribbed sleeve and cork portion to the interior of the bottle, such that one open end of said tube is in the interior of the bottle and the opposite open end of said breather tube is proximate to said elliptical airflow aperture when said pouring dispenser is attached to the bottle, wherein breather tubes of different lengths may be interchangeably connected to a connection point at the base of said nozzle channel.

11. The pouring dispenser as claimed in claim 10 wherein the cork portion and the pouring nozzle are integrally formed as a single unit.

12. The pouring dispenser as claimed in claim 1 wherein the cork portion and the pouring nozzle are molded as single unit and are non separable.

13. The pouring dispenser as claimed in claim 10 wherein the cork portion and the pouring nozzle are molded as single unit and are non separable.

14. The pouring dispenser as claimed in claim 1 wherein said removable breather tube is replaced by a replacement removable breather tube that is of a different length than said removable breather tube to facilitate a different pouring speed.

15. The pouring dispenser as claimed in claim 10 wherein said removable breather tube is replaced by a replacement removable breather tube that is of a different length than said removable breather tube to facilitate a different pouring speed.

16. The pouring dispenser as claimed in claim 11 wherein said removable breather tube is replaced by a replacement removable breather tube that is of a different length than said removable breather tube to facilitate a different pouring speed.

17. The pouring dispenser as claimed in claim 12 wherein said removable breather tube is replaced by a replacement removable breather tube that is of a different length than said removable breather tube to facilitate a different pouring speed.

18. The pouring dispenser as claimed in claim 13 wherein said removable breather tube is replaced by a replacement removable breather tube that is of a different length than said removable breather tube to facilitate a different pouring speed.

* * * * *